US010352187B2

(12) United States Patent
Keenan

(10) Patent No.: US 10,352,187 B2
(45) Date of Patent: Jul. 16, 2019

(54) VARIABLE STATOR VANE RIGGING

(71) Applicant: ROLLS-ROYCE plc, London (GB)

(72) Inventor: Michael P. Keenan, Sheffield (GB)

(73) Assignee: ROLLS-ROYCE plc, London (GB)

( * ) Notice: Subject to any disclaimer, the term of this patent is extended or adjusted under 35 U.S.C. 154(b) by 216 days.

(21) Appl. No.: 15/669,358

(22) Filed: Aug. 4, 2017

(65) Prior Publication Data

US 2018/0058246 A1 Mar. 1, 2018

(30) Foreign Application Priority Data

Sep. 1, 2016 (GB) ..... 1614803.3

(51) Int. Cl.
*F01D 17/16* (2006.01)
*F01D 9/04* (2006.01)

(52) U.S. Cl.
CPC ..... *F01D 17/162* (2013.01); *F01D 9/042* (2013.01); *F05D 2220/32* (2013.01); *F05D 2230/644* (2013.01); *F05D 2240/12* (2013.01); *F05D 2260/74* (2013.01); *F05D 2260/83* (2013.01)

(58) Field of Classification Search
None
See application file for complete search history.

(56) References Cited

U.S. PATENT DOCUMENTS 2,679,606 A * 5/1954 Baudry ..... H02K 5/148 310/112
3,263,963 A * 8/1966 Hanschke ..... F01D 9/045 415/163
3,314,595 A * 4/1967 Burge ..... F01D 17/162 415/160
4,773,821 A 9/1988 Gonthier et al.
(Continued)

FOREIGN PATENT DOCUMENTS

EP 0274931 A2 7/1988
EP 2949878 A1 12/2015
(Continued)

OTHER PUBLICATIONS

Jan. 16, 2018 Search Report issued in European Patent Application No. 17184890.
(Continued)

*Primary Examiner* — Michael Lebentritt
(74) *Attorney, Agent, or Firm* — Oliff PLC

(57) ABSTRACT

A variable vane mechanism for adjusting the angle of stator vanes in a gas turbine engine is provided. The mechanism includes a circumferentially extending unison ring that is driven circumferentially around a casing by an actuator. The unison ring is connected to the stator vanes via levers such that the angle of the vanes changes with circumferential movement of the unison ring. The unison ring and the casing are each provided with at least one rigging hole in order to set the initial angle of the vanes. At least one of the unison ring and the casing are each provided with at least two
(Continued)

rigging holes, so that the initial angle of the vanes can be adjusted by selecting different combinations of rigging holes. This may allow accumulations in tolerances to be compensated for and/or may allow the engine to be tested at different initial vane angles.

15 Claims, 4 Drawing Sheets

(56) References Cited

U.S. PATENT DOCUMENTS 4,812,106 A * 3/1989 Purgavie ..... F01D 17/162 415/139
4,925,364 A * 5/1990 Das ..... F01D 17/162 411/183
5,215,434 A * 6/1993 Greune ..... F01D 17/162 415/150
5,466,122 A 11/1995 Charbonnel et al.
5,549,448 A * 8/1996 Langston ..... F01D 17/162 29/889.2
5,601,401 A * 2/1997 Matheny ..... F01D 17/162 415/160
6,092,984 A * 7/2000 Bouyer ..... F16F 15/04 415/119
6,471,471 B1 * 10/2002 Bouyer ..... F01D 17/16 415/1
7,244,098 B2 * 7/2007 Bromann ..... F01D 17/162 415/160
7,690,889 B2 * 4/2010 Giaimo ..... F01D 17/162 415/160
7,713,022 B2 * 5/2010 Major ..... F01D 17/162 29/889.22
8,015,667 B2 * 9/2011 Bonner ..... E05F 15/53 16/338
8,066,474 B1 * 11/2011 Jansen ..... F01D 17/16 251/129.1
8,123,472 B2 * 2/2012 Redgwell ..... F01D 17/162 415/155
8,393,857 B2 * 3/2013 Copeland ..... F01D 17/162 415/160
8,414,248 B2 * 4/2013 Perez ..... F01D 17/162 415/1
8,435,000 B2 * 5/2013 Wong ..... F01D 17/162 415/160
8,528,181 B2 * 9/2013 Maurell ..... F01D 25/26 254/89 R
8,714,916 B2 * 5/2014 Jarrett, Jr. ..... F01D 17/162 415/160
9,097,137 B2 * 8/2015 Suciu ..... F04D 29/563
9,303,524 B2 * 4/2016 Hensley ..... F01D 17/162
9,422,825 B2 * 8/2016 Do ..... F02C 9/20
10,132,179 B2 * 11/2018 LeBlanc ..... F01D 25/285
10,161,407 B2 * 12/2018 St. Mary ..... F01D 17/20
10,184,350 B2 * 1/2019 Hall ..... F01D 17/162
10,190,599 B2 * 1/2019 Suciu ..... F04D 29/563
2010/0247293 A1 * 9/2010 McCaffrey ..... F01D 9/041 415/160
2012/0195751 A1 * 8/2012 Gasmen ..... F01D 17/162 415/213.1
2018/0017080 A1 * 1/2018 Walters ..... F02C 7/042
2018/0252553 A1 * 9/2018 Daniels ..... G01D 18/00

FOREIGN PATENT DOCUMENTS

GB 2235731 A 3/1991
GB 2479064 A 9/2011

OTHER PUBLICATIONS

Jan. 25, 2017 Search Report issued in British Patent Application No. 1614803.3.

* cited by examiner

VARIABLE STATOR VANE RIGGING

CROSS-REFERENCE TO RELATED APPLICATIONS

This specification is based upon and claims the benefit of priority from UK Patent Application Number 1614803.3 filed on 1 Sep. 2016, the entire contents of which are incorporated herein by reference.

BACKGROUND

1. Field of the Disclosure

This disclosure relates to a variable stator vane such as a variable inlet guide vane.

2. Description of the Related Art

In a gas turbine engine having a multi-stage axial compressor, the turbine rotor is turned at high speed so that air is continuously induced into the compressor, accelerated by the rotating blades and swept rearwards onto an adjacent row of stator vanes. Each rotor-stator stage increases the pressure of the air passing through the stage and at the final stage of a multistage compressor the air pressure may be many times that of the inlet air pressure.

In addition to converting the kinetic energy of the air into pressure the stator vanes also serve to correct the deflection given to the air by the rotor blades and to present the air at the correct angle to the next stage of rotor blades.

As compressor pressure ratios have increased it has become more difficult to ensure that the compressor will operate efficiently over the operational speed range of the engine. This is because the inlet to exit area ratios of the stator vanes required for high pressure operation can result in aerodynamic inefficiency and flow separation at low operational speeds and pressures.

In applications where high pressure ratios are required from a single compressor spool the above problem may be overcome by using variable stator vanes. Variable stator vanes permit the angle of incidence of the exiting air onto the rotor blades to be corrected to angles which the rotor blades can tolerate without flow separation.

The use of variable stator vanes permits the angle of one or more rows of stator vanes in a compressor to be adjusted, while the engine is running, for example in accordance with the rotational speed and mass flow of the compressor.

The term variable inlet guide vane (VIGV) used herein refers specifically to vanes in the row of variable vanes at the entry to a compressor. The term variable stator vane (VSV) used herein refers generally to the vanes in the one or more rows of variable vanes in the compressor which may include a VIGV row. A function of such VIGVs or VSVs may be to improve the aerodynamic stability of the compressor when it is operating at relatively low rotational speeds at off-design, i.e. non-optimum speed, conditions.

At low speed and mass flow conditions, the variable vanes may be considered to be in a "closed" position, directing and turning the airflow in the direction of rotation of the rotor blades immediately downstream. This reduces the angle of incidence at entry to the blades and hence the tendency of them to stall. As the rotational speed and mass flow of the compressor increases with increasing engine power, the vanes are moved progressively and in unison towards what may be considered to be an "open" position.

The movement is controlled such that the flow angle of the air leaving the stator vanes continues to provide an acceptable angle of incidence at entry to the downstream row of rotor blades. When the vanes are in the fully "open" position, the angles of all of the stator vanes and rotor blades will typically match the aerodynamic condition at which the compressor has been designed i.e. its "design point".

In order to adjust the angle of incidence of the VSVs, a variable vane mechanism may be provided in which linear movement of an actuator turns a ring (which may be referred to as a unison ring) which encircles the engine. This ring is linked to the vanes via levers and pins. Hence as the actuator moves, its linear motion translates into turning of the vanes about their longitudinal axis, thereby changing their angle of incidence.

During set-up of the VSV, it is necessary to calibrate the position of the vanes to the position of the actuator. Previous arrangements for calibrating the vane position and the actuator position have proved not to have sufficient accuracy, in particular between different engine builds.

Furthermore, it may be desirable to check and/or adjust the position of the vanes relative to the actuator after a certain period of use, because the relative positions may either drift from that which was originally set, or may benefit from adjustment after a period of use, for example due to component wear.

Thus, it would be desirable to be able to accurately calibrate and/or adjust the position of the vanes in a VSV stage, for example to allow accurate positioning relative to an actuator.

SUMMARY

According to an aspect, there is provided a method of setting an angle of a set of variable stator vanes. The method comprises providing a unison ring that is radially offset from a casing. The circumferential position of the unison ring is related to the angle of the stator vanes. Each of the unison ring and the casing is provided with at least one rigging hole, and at least one of the unison ring and the casing is provided with at least two rigging holes that are capable of being aligned with one or more rigging holes (for example a single rigging hole) of the other of the unison ring and the casing. The method further comprises moving the unison ring circumferentially relative to the casing so as to align a unison ring rigging hole with a casing rigging hole; and inserting a rigging pin through the aligned rigging holes so as to circumferentially fix the position of the unison ring relative to the casing.

According to an aspect, there is provided a variable stator vane stage for a gas turbine engine comprising:

a set of variable stator vanes arranged circumferentially within a casing;

a unison ring, the unison ring being attached to each variable stator vane via a respective lever such that circumferential movement of the unison ring results in a change in angle of incidence of the stator vanes; and an actuator connected to the unison ring using a drive bar, the actuator being configured to drive the unison ring in a circumferential direction via the drive bar.

Each of the unison ring and the casing is provided with at least one rigging hole, and at least one of the unison ring and the casing is provided with at least two rigging holes that are capable of being aligned with a single rigging hole of the other of the unison ring and the casing, such that the angle of incidence of the stator vanes can be set during rigging by inserting a pin through the aligned holes.

Where reference is made to the angle of the stator vanes, this may mean the angle of incidence of the stator vanes and/or the angle of the camber line, for example at the leading edge or trailing edge, for example relative to an axial direction. Movement of the unison ring (for example in the circumferential direction) may directly result in a change in angle of the stator vanes, for example by rotation of each vane about a substantially radial and/or spanwise direction.

Where reference is made to holes being aligned, this may mean that they have the same circumferential and axial position, but may be radially separated. The terms axial, radial and circumferential may have their conventional meanings within a gas turbine engine and/or rotor or stator stage of a gas turbine engine.

The rigging holes may be through holes (i.e. holes that extend through the component) or blind holes (i.e. holes that do not extend entirely through the component). Purely by way of example, the unison rigging hole or holes may be through hole(s) and/or the casing rigging hole or holes may be blind holes.

The methods and/or apparatus described and/or claimed herein may allow the angle of the VSVs to be set and/or adjusted accurately, for example during initial setting (or rigging) of the vane angles. For example, providing more than one rigging hole in at least one of the casing and the unison ring allows the angle of the vanes to be set to at least two positions. This allows the angle of the vanes to be set and/or adjusted more precisely, for example in order to take into account (or compensate for) variations between engine builds that may result from an accumulation of geometry variations, which may be within acceptable tolerance requirements. Once the desired combination casing and unison ring rigging holes has been determined, it may desirable to re-use that combination in subsequent engine re-builds.

Additionally or alternatively, the ability to set and/or adjust the precise angle of the vanes may also allow the vanes to be re-set to a desired angle, for example at a subsequent re-build, should they drift away from their originally set angle, for example due to wear of components during use. Additionally or alternatively, the ability to adjust and/or set the angle of the vanes may be useful during engine development, for example allowing the engine to be tested with the vanes initially set to more than one initial angle.

The methods and/or apparatus described and/or claimed herein may allow a datum angle of the vanes to be set accurately before the engine is fully assembled and/or when the engine/stage is in a state that allows the angle of the vanes to be measured. For example, once the stage is fully assembled in an engine, it may no longer be possible to measure the vane angles, and so setting a datum position at that time may not be possible.

Aligning holes such that a pin can be inserted in order to fix the casing and the unison ring relative to each other may mean that the vanes can be set to more than one initial angle in an accurate and repeatable manner.

Each of the unison ring and the casing may be provided with at least two rigging holes. For example one or both of the unison ring and the casing may be provided with two, three, four, five, six, seven, eight, nine, ten or more than ten rigging holes.

Providing more rigging holes allow the vanes to be set to a greater number of different angles. This may allow greater adjustment and/or precision. In general, the rigging hole(s) in the unison ring and the casing may be thought of as providing a Vernier-type adjustment. Providing a greater number of rigging holes in the casing and/or the unison ring may provide greater range and/or precision of the adjustment.

The angle between two neighbouring rigging holes in the unison ring and/or the casing may be set to be any suitable for allowing the desired adjustment. For example, the angle between two neighbouring rigging holes in the unison ring and/or the casing may be set to be in the range of from 0.1 degrees to 15 degrees, 10 degrees or 5 degrees, for example 0.2 degrees and 4 degrees, for example 0.25 degrees and 2.5 degrees, for example 0.3 degrees and 2 degrees, for example 0.5 degrees and 1 degree. The angle between neighbouring holes may depend on, for example, the size of the engine, for example the size of the casing within which the VSVs are housed. For example, the angle between neighbouring rigging holes in a larger diameter casing and/or unison ring may be less than the angle between neighbouring rigging holes in a smaller diameter casing and/or unison ring. Purely by way of example, the angle between two neighbouring holes may be greater where the arrangement is used in a development engine compared to where the arrangement is for use in a production engine, for example to correct for variations due to tolerance.

The method of setting the angle of a set of variable stator vanes may further comprise measuring the angle of at least one of the stator vanes, for example using an inclinometer. For example the angle of incidence of one or more vanes may be measured, for example the angle between the axial direction and an inclinometer placed on the pressure surface of a vane, for example at a particular span (or radial position). The angle may be measured with the pin inserted in at least two different sets off rigging holes (where a set of rigging holes is formed by the alignment of one casing rigging hole and one unison ring rigging hole). The measured angle(s) may be compared with a desired angle. The set of rigging holes for which the measured angle is closest to the desired angle may be selected for final insertion of the pin. Thus, the pin may be inserted through the combination of unison ring rigging hole and casing rigging hole for which the measured angle best matches a desired angle.

According to an aspect, there is provided a method of calibrating (or rigging) a set of variable stator vanes. The method comprises setting the variable stator vanes to a desired angle using any one of the methods described and/or claimed herein. With the variable stator vanes set to the desired angle (for example, once the desired combination of unison ring rigging hole and casing rigging hole has been selected), the unison ring may be connected to an actuator using a drive bar, the actuator being configured to drive the unison ring in a circumferential direction via the drive bar in use. For example, the drive bar may be rotatably connected to the actuator bar and the unison ring in order to allow linear movement of a linear actuator to provide circumferential movement (or rotation) of the unison ring.

The length of the drive bar may be selected based on the distance between the actuator and a drive bar location position on the unison ring. An adjustable length drive bar may be used, so that the length of the drive bar may be adjusted as required in order to connect the actuator to the unison ring with the unison ring at the position required for the desired combination of unison ring rigging hole and casing rigging hole. Alternatively, a dedicated length of drive bar may be selected in dependence on the selected combination of rigging holes.

According to an aspect, there is provided a method of assembling a set of variable stator vanes. The method comprises calibrating (or rigging) the set of variable stator vanes using any one of the methods described and/or claimed herein. The method comprises removing the rigging pin (for example after the drive bar has been connected between the unison ring and the actuator). In such an arrangement, the variable stator vanes may be connected to the unison ring using respective levers such that the angle of the vanes is determined by the circumferential position of the unison ring (for example, relative to the circumferential position of the casing). Removal of the rigging pin allows relative circumferential movement between the unison ring and the casing. With the rigging pin still in position, such relative circumferential movement may not be possible.

According to an aspect, there is provided a method of manufacturing a gas turbine engine having at least one variable stator vane stage, the method comprising assembling at least one variable stator vane stage using one of the methods described and/or claimed herein.

According to an aspect, there is provided a gas turbine engine comprising at least one variable stator vane row as described and/or claimed herein.

According to an aspect, there is provided a casing for a variable stator vane stage as described and/or claimed herein, wherein the casing is provided with at least two rigging holes.

According to an aspect, there is provided a unison ring for a variable stator vane stage as described and/or claimed herein, wherein the unison ring is provided with at least two rigging holes.

According to an aspect, there is provided a method of testing a gas turbine engine having a VSV arrangement as described and/or claimed herein, the method comprising:

holding a first combination of unison ring and casing rigging holes in alignment using a rigging pin and connecting the unison ring to the actuator using the drive bar;

removing the rigging pin so as to allow the unison ring to move circumferentially relative to the casing in a first rigged arrangement;

testing the engine performance in the first rigged arrangement;

holding a second combination of unison ring and casing rigging holes in alignment using the rigging pin and connecting the unison ring to the actuator using the drive bar;

removing the rigging pin so as to allow the unison ring to move circumferentially relative to the casing in a second rigged arrangement; and testing the engine performance in the second rigged arrangement.

The method may comprise comparing the engine performance in the first and second rigged arrangements. The method may be performed as part of an engine development program and/or an engine testing program and/or engine set-up/installation, for example.

The steps of testing the engine performance may comprise measuring one or more engine parameters at different engine operating conditions and/or with the VSVs at different angles (the different VSV angles may be determined by the actuator position during running of the engine, as normal). At least some of the same tests may be performed in both the first and second rigged arrangements. Of course, the method may be repeated for more than two rigged arrangements (i.e. more than two different combinations of unison and casing rigging holes).

The skilled person will appreciate that except where mutually exclusive, a feature described in relation to any one of the above aspects may be applied to any other aspect. Furthermore except where mutually exclusive any feature described herein may be applied to any aspect and/or combined with any other feature described herein.

BRIEF DESCRIPTION OF THE DRAWINGS

Embodiments will now be described by way of example only, with reference to the Figures, in which.

DETAILED DESCRIPTION OF THE DISCLOSURE

Figure 1:
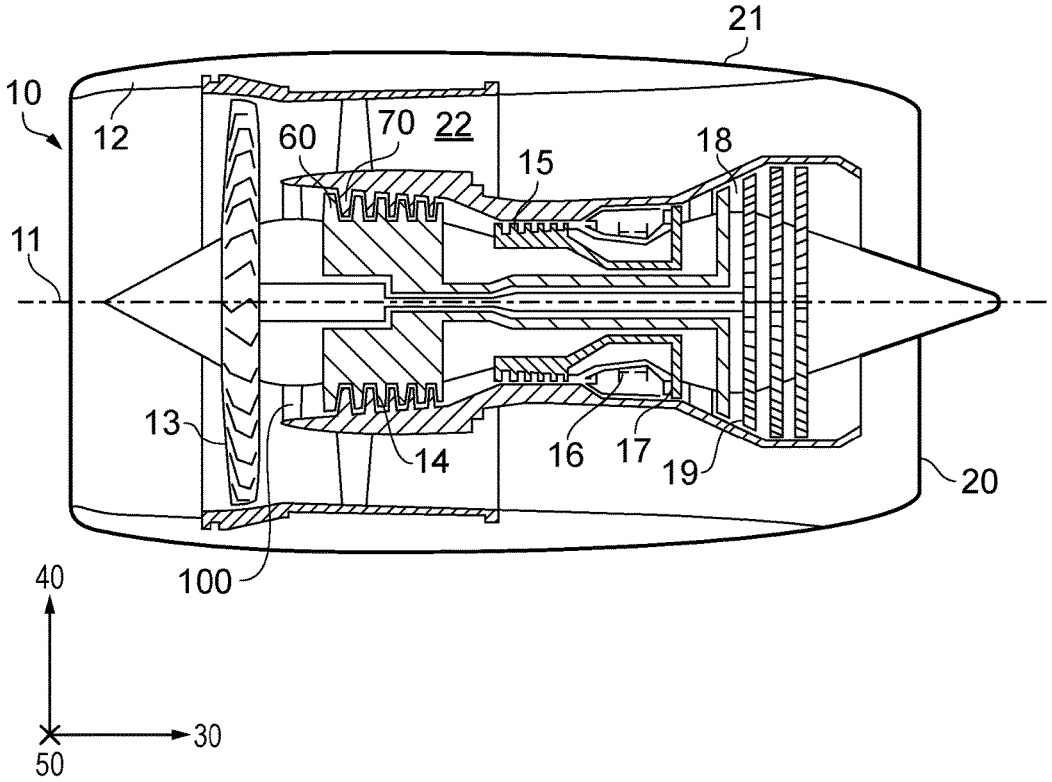
FIG. 1 is a sectional side view of a gas turbine engine on accordance with the present disclosure.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

At least one of the compressors 14, 15 and the turbines 17, 18, 19 comprise stages having rotor blades in rotor blade rows (labelled 60 by way of example in relation to the intermediate pressure compressor in FIG. 1) and stator vanes in stator vane rows (labelled 70 by way of example in relation to the intermediate pressure compressor in FIG. 1).

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan. Further, the engine may not comprise a fan 13 and/or associated bypass duct 22 and/or nacelle 21. Whilst the described example relates to a turbofan engine, the disclosure may apply, for example, to any type of gas turbine engine, such as a turbojet or turboprop engine, for example.

The geometry of the gas turbine engine 10, and components thereof, is defined by a conventional axis system, comprising an axial direction 30 (which is aligned with the rotational axis 11), a radial direction 40, and a circumferential direction 50 (shown perpendicular to the page in the FIG. 1 view). The axial, radial and circumferential directions 30, 40, 50 are mutually perpendicular.

Any one of the stator vane rows 70 in the gas turbine engine 10 may be a variable stator vane (VSV) row. Such a variable stator vane row 70 comprises a variable vane mechanism that allows the angle of the vanes 70 (for example the angle of incidence of the vanes 70) to be adjusted in use. Purely by way of example, the gas turbine engine 10 shown in FIG. 1 has a VSV row at the inlet to the core of the engine in the form of a variable inlet guide vane (VIGV) row 100.

Figure 2:
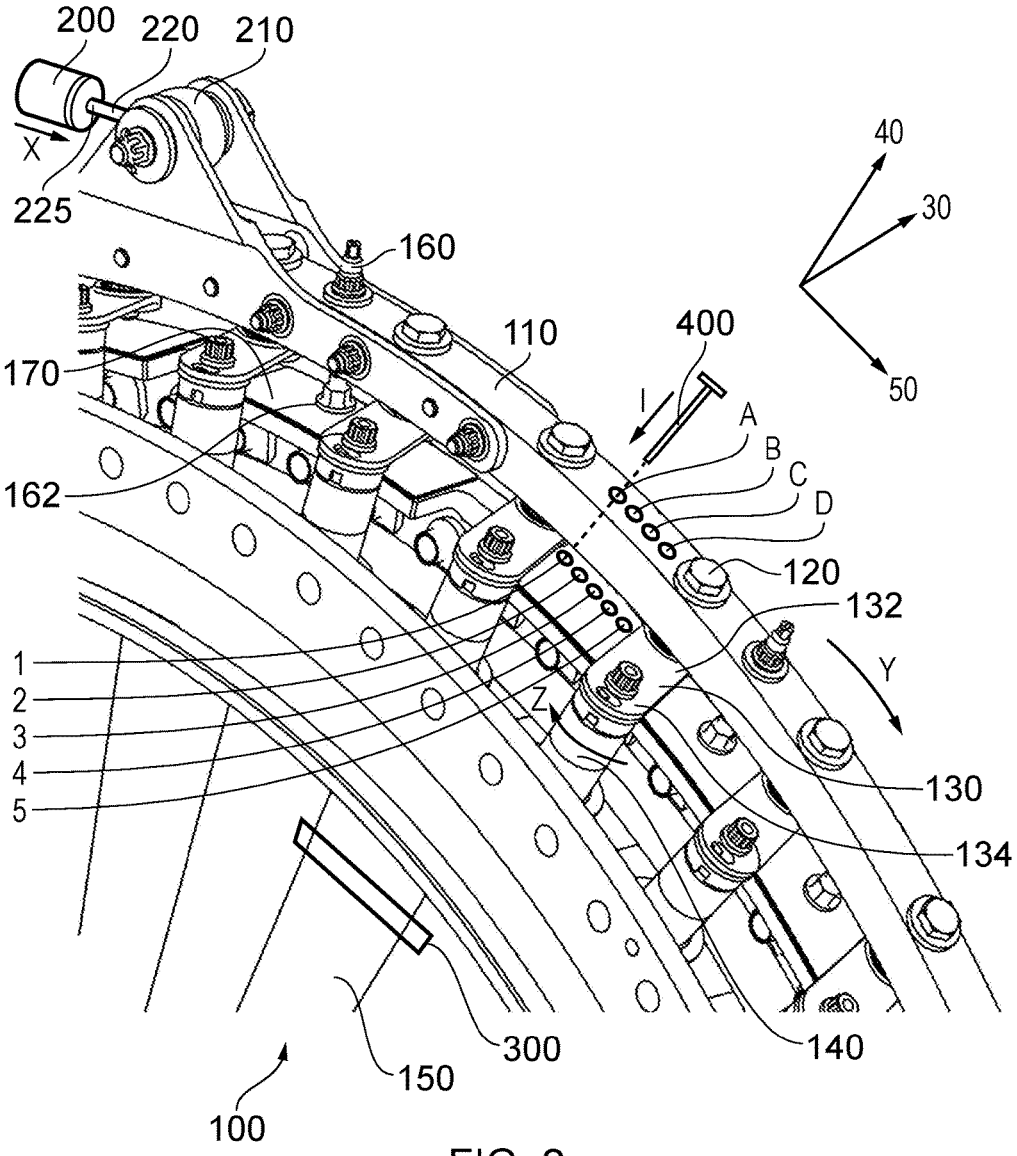
FIG. 2 is a schematic perspective view of part of a variable stator vane arrangement in accordance with an example of the present disclosure.

FIG. 2 shows a part of the VSV (or VIGV) row 100 in greater detail, including a variable vane mechanism. The VSV 100 comprises variable stator vanes 150. The angle of the variable stator vanes 150 may be adjusted during use. In order to vary the angle of the stator vanes 150, an actuator 200 may be used, which may be a linear actuator as in the FIG. 2 example. The actuator 200 is connected to a unison ring 110 (which may be referred to as a drive ring 110) via a drive bar 220 that connects to the unison ring 110 via a joint (which may be a hinge) 210. The joint 210 may allow rotation of the unison ring 110 relative to the actuator 200, for example about an axial direction running through the joint. This may be particularly suitable for arrangement having a linear actuator.

Movement of the actuator 200 (which may be, for example, based on a control signal which may in turn be based on an engine operating condition and/or thrust demand) causes the unison ring 110 to rotate about the axial direction 30. In the FIG. 2 example, linear movement X of the actuator 200 is converted into circumferential movement Y of the unison ring 110.

The unison ring 110 has at least one drive pin 120 connected thereto. The drive pin 120 is rigidly connected to the unison ring 110 such that the unison ring 110 and the drive pin 120 move together. The drive pin 120 is connected to a first end 132 of a lever 130. The first end 132 of the lever 130 therefore moves with the drive pin 120, but may rotate relative to it about a longitudinal axis of the drive pin 120.

A second end 134 of the lever 130 may be separated from the first end 132 in a direction that has at least a component (for example a major component) in the axial direction 30. The second end 134 may be spaced from the first end 132 in a substantially axial direction 30. The second end 134 of the lever 130 is connected (for example rigidly connected) to a vane 150. The second end 134 may, for example, be connected to a spindle 140 that extends from a vane 150, as in the FIG. 2 example. The second end 134 of the lever may be rigidly fixed in the axial 30, radial 40 and circumferential 50 directions, but may be rotatable about a radial direction 40, as indicated by the arrow Z in FIG. 2.

Accordingly, the circumferential movement Y of the unison ring 110 (which may be described as rotation about the axial direction 30) may be converted into rotation Z of the vane 150 about a substantially radial direction 40. This may be achieved by the drive pin 120 and the lever 130.

In order to ensure that the VSV arrangement 100 is reliable (for example accurate and/or repeatable) the unison ring 110 must be kept concentric with the rest of the arrangement. In order to achieve this, one or more centralising pins 160 is provided. Each centralising pin 160 is in slidable contact with a guide surface, which may be part of a casing 170 within which the variable vanes 150 are housed. In use, the guide surface remains stationary, and the first end 162 of the centralising pin 160 slides across, and remains in contact with the guide surface. Accordingly, the position (for example at least the radial position) of the unison ring 110 relative to the casing 170 may be determined and/or maintained by the centralising pin 160. The casing 170 may be said to be rigidly attached to and/or an integral part of the gas turbine engine 10. Other arrangements may have alternative mechanisms for keeping the unison ring 110 concentric with the rest of the arrangement.

The unison ring 110 is provided with holes A, B, C, D, which may be through holes A, B, C, D as in the example illustrated in FIG. 2. The casing 170 is also provided with holes 1, 2, 3, 4, 5, which may be through holes or blind holes as in the FIG. 2 example. In the example shown in FIG. 2, the casing 170 is provided with five holes 1, 2, 3, 4, 5 and the unison ring 110 is provided with four holes A, B, C, D, but it will be appreciated that the casing 170 and unison ring 110 may be provided with any suitable number of holes in accordance with the present disclosure.

Figure 3:
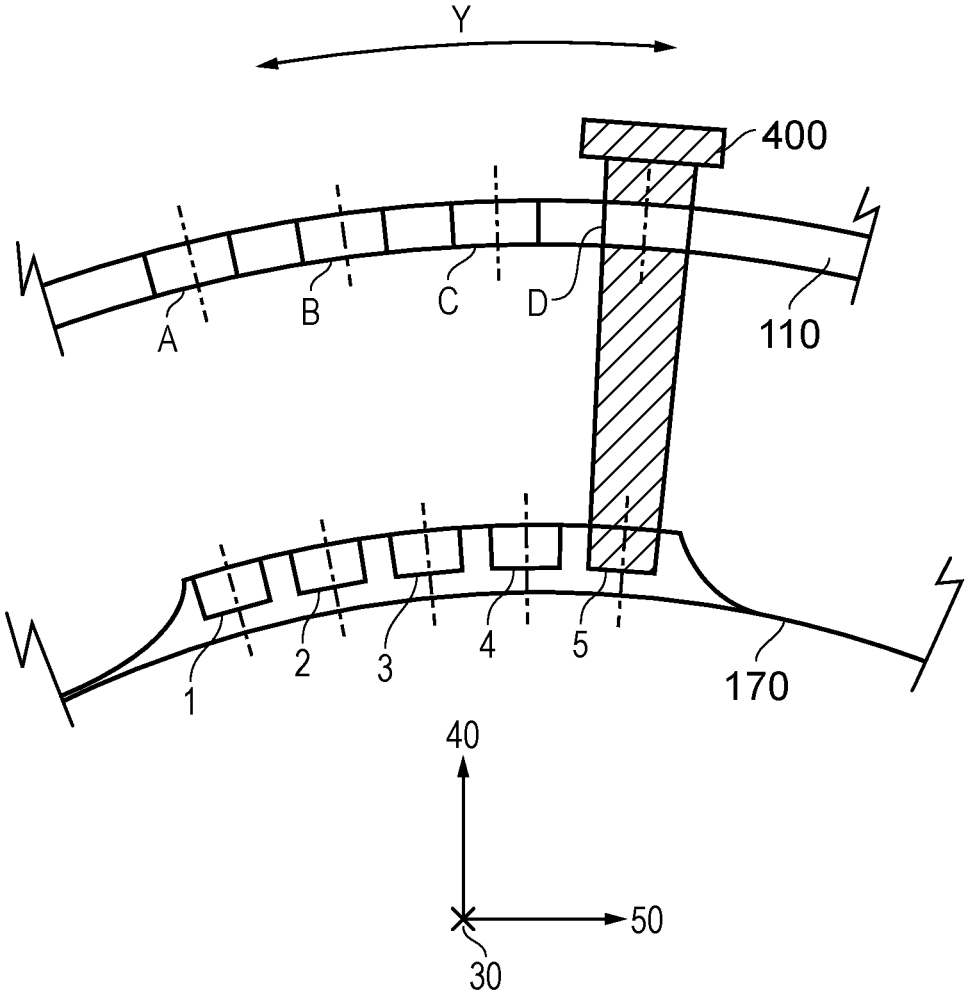
FIG. 3 is a schematic view showing unison ring rigging holes, casing rigging holes and a rigging pin forming part of a variable stator vane arrangement in accordance with an example of the present disclosure.
Figure 4:
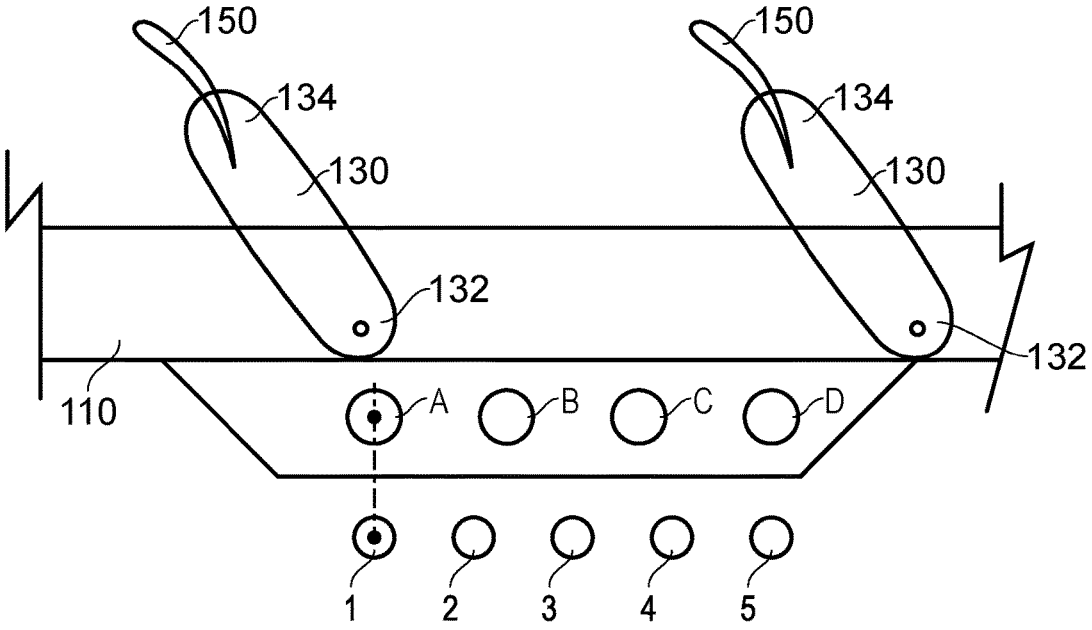
FIG. 4 is a schematic example of a part of a variable stator vane arrangement in accordance with an example of the present disclosure.

FIG. 3 is a close-up schematic view of the holes 1, 2, 3, 4, 5 of the casing 170 and the holes A, B, C, D in the unison ring 110, which may be referred to as rigging holes. FIG. 4 is another schematic view, showing the unison ring 110 with the holes A, B, C, D formed therein, along with levers 130 attaching vanes 150 to the unison ring, as described above in relation to FIG. 2. The FIG. 4 schematic is generally a view along a radial direction, but the schematically shown holes 1, 2, 3, 4, 5 in the casing 170 are shown as being offset from the holes A, B, C, D in the unison ring 110 in the axial direction 30 purely to aid the clarity of the Figure. In the embodiment itself, the holes 1, 2, 3, 4, 5 in the casing 170 are axially aligned with the holes A, B, C, D in the unison ring 110.

During set-up, or rigging, of the VSV stage 100, for example, the unison ring 110 may be rotated circumferentially in the direction Y shown in the Figures until one of the holes A, B, C, D in the unison ring 110 is circumferentially aligned with one of the holes 1, 2, 3, 4, 5 of the casing 170. The unison ring 110 may be rotated in any suitable manner, for example by manual rotation. The actuator 200 and the unison ring 110 may be disconnected (or not connected) during this initial set-up in order to allow the unison ring to be rotated into the desired position. In FIG. 2, the holes "1" and "A" are shown as being aligned, and in FIG. 3 the holes "5" and "D" are shown as being aligned, although any two holes may be aligned by rotating the unison ring 110 to a different position.

The choice of which holes to align may be determined by which combination of aligned holes result in the vanes 150 being set to the desired angle. This desired angle may result from a different combination of rigging holes for different engine builds, for example due to slightly different alignment of components resulting from manufacture and/or assembly tolerances. The angle of the vanes 150 may be determined by any suitable means, for example using an inclinometer 300, as shown by way of example in FIG. 2.

A rigging pin 400 may be used to fix the circumferential position of the unison ring 110 and the casing 170 relative to each other. The rigging pin 400 may prevent the unison ring 110 from being rotated circumferentially. The rigging pin 400 may be passed through (or into, depending on whether the hole is a through hole or a blind hole) the aligned holes, i.e. through one of the holes 1, 2, 3, 4, 5 of the casing 170 and one of the holes A, B, C, D in the unison ring 110. Accordingly, once the desired combination of holes has been decided upon, the unison ring 110 and the casing 170 may be fixed together using the rigging pin 400.

With the rigging pin 400 fixing the unison ring 110 in position, the actuator 200 may be connected to the unison ring 110 using the drive bar 220, as described elsewhere herein.

The distance between the actuator 200 and the fixing position 210 at which the drive bar 220 is fixed to the unison ring 110 may only be known once the combination of rigging holes 1, 2, 3, 4, 5 and holes A, B, C, D has been selected. The length of the drive bar 220 may be determined by this distance, as in the illustrated arrangement. Accordingly, either a bespoke length drive bar 220 may be used depending on the combination of rigging holes chosen, or the drive bar 220 may be adjustable in length, for example by having an adjustment mechanism, which may comprise a screw thread 225 as illustrated in FIG. 2.

After the actuator 200 has been connected to the unison ring 110 using the drive bar 220, the rigging pin 400 may be removed, thereby allowing circumferential rotation of the unison ring 110 in response to movement of the actuator 200. Accordingly, after the rigging pin 400 has been removed, the angle of the vanes 150 in the VSV stage 100 can be altered as normal by the actuator 200, for example in response to different operating conditions (for example different thrust demands) during operation of the gas turbine engine 10.

Any suitable angular spacing between neighbouring holes 1, 2, 3, 4, 5 of the casing 170 and neighbouring holes A, B, C, D in the unison ring 110 may be chosen, as set out elsewhere herein. In any arrangement according to the present disclosure, the angular spacing between neighbouring holes 1, 2, 3, 4, 5 of the casing 170 may be different to the angular spacing between neighbouring holes A, B, C, D in the unison ring 110, as illustrated by way of example in the FIGS. 3 and 4 arrangements. This may allow a greater number of angular positions to be provided and/or a smaller angular gap between combinations of holes for a given number of casing rigging holes 1, 2, 3, 4, 5 and unison ring rigging holes A, B, C, D.

As noted elsewhere herein, the combination of casing rigging holes 1, 2, 3, 4, 5 and unison ring rigging holes A, B, C, D may be selected in order to achieve a desired angle of the vanes 150 during initial set-up, or rigging, of the VSV stage 100. Additionally or alternatively, the arrangements and/or methods described and/or claimed herein may be used during testing and/or development of an engine in order to measure and/or understand the performance of such an engine with the vanes 150 rigged to various different initial angles using different combinations of casing rigging holes 1, 2, 3, 4, 5 and unison ring rigging holes A, B, C, D.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

I claim:

1. A method of setting an angle of a set of variable stator vanes comprising:

providing a unison ring that is radially offset from a casing, wherein:

the circumferential position of the unison ring is related to the angle of the stator vanes; and each of the unison ring and the casing is provided with at least one rigging hole, and at least one of the unison ring and the casing is provided with at least two rigging holes that are both capable of being aligned with one or more rigging holes of the other of the unison ring and the casing, the method further comprising:

moving the unison ring circumferentially relative to the casing so as to align a unison ring rigging hole with a casing rigging hole; and inserting a rigging pin through the aligned rigging holes so as to circumferentially fix the position of the unison ring relative to the casing.

2. A method of setting the angle of a set of variable stator vanes according to claim 1, wherein each of the unison ring and the casing is provided with at least two rigging holes.

3. A method of setting the angle of a set of variable stator vanes according to claim 1 wherein the angle between two neighbouring rigging holes in the unison ring and/or the casing is in the range of from 0.1 degrees and 10 degrees.

4. A method of setting the angle of a set of variable stator vanes according to claim 1, further comprising:

measuring the angle of at least one of the stator vanes using an inclinometer; and inserting the pin through the combination of unison ring rigging hole and casing rigging hole for which the measured angle best matches a desired angle.

5. A method of calibrating a set of variable stator vanes comprising:

setting the variable stator vanes to a desired angle using the method of claim 1; and with the variable stator vanes set to the desired angle, connecting the unison ring to an actuator (200) using a drive bar (220), the actuator being configured to drive the unison ring in a circumferential direction (50, Y) via the drive bar in use.

6. A method of calibrating a set of variable stator vanes according to claim 5, further comprising selecting the length of the drive bar based on the distance between the actuator and a drive bar location position on the unison ring.

7. A method of assembling a set of variable stator vanes comprising:

calibrating the set of variable stator vanes using the method of claim 5; and removing the rigging pin, wherein the variable stator vanes are connected to the unison ring using respective levers such that the angle of the vanes is determined by the circumferential position of the unison ring.

8. A method of manufacturing a gas turbine engine having at least one variable stator vane stage, the method comprising assembling at least one set of variable stator vanes in a variable stator vane stage using the method of claim 7.

9. A variable stator vane stage for a gas turbine engine comprising:

a set of variable stator vanes arranged circumferentially within a casing;

a unison ring, the unison ring being attached to each variable stator vane via a respective lever such that circumferential movement of the unison ring results in a change in angle of incidence of the stator vanes; and an actuator connected to the unison ring using a drive bar, the actuator being configured to drive the unison ring in the circumferential direction via the drive bar, wherein:

each of the unison ring and the casing is provided with at least one rigging hole, and at least one of the unison ring and the casing is provided with at least two rigging holes that are both capable of being aligned with at least one rigging hole of the other of the unison ring and the casing, such that the angle of incidence of the stator vanes can be set during rigging by inserting a rigging pin through the aligned holes.

10. A variable stator vane stage according to claim 9, wherein each of the unison ring and the casing is provided with at least two rigging holes.

11. A variable stator vane stage according to claim 9, wherein the angle between two neighbouring rigging holes in the unison ring and/or the casing is in the range of from 0.1 degrees and 5 degrees.

12. A gas turbine engine comprising at least one variable stator vane stage according to claim 9.

13. A casing for a variable stator vane stage according to claim 9, wherein the casing is provided with at least two rigging holes.

14. A unison ring for a variable stator vane stage according to claim 9, wherein the unison ring is provided with at least two rigging holes.

15. A method of testing a gas turbine engine according to claim 12 comprising:

holding a first combination of unison ring and casing rigging holes in alignment using a rigging pin and connecting the unison ring to the actuator using the drive bar;

removing the rigging pin so as to allow the unison ring to move circumferentially relative to the casing in a first rigged arrangement;

testing the engine performance in the first rigged arrangement;

holding a second combination of unison ring and casing rigging holes in alignment using the rigging pin and connecting the unison ring to the actuator using the drive bar;

removing the rigging pin so as to allow the unison ring to move circumferentially relative to the casing in a second rigged arrangement;

testing the engine performance in the second rigged arrangement.

* * * * *